US011156056B2

(12) United States Patent
McCormick et al.

(10) Patent No.: US 11,156,056 B2
(45) Date of Patent: Oct. 26, 2021

(54) STATION KEEPING AND EMERGENCY DISCONNECTING CAPABILITY FOR A VESSEL CONNECTED TO A SUBSEA WELLHEAD IN SHALLOW WATER

(71) Applicants: Craig McCormick, Houston, TX (US); Scott Reynolds, Houston, TX (US); Darrel Pelley, Houston, TX (US)

(72) Inventors: Craig McCormick, Houston, TX (US); Scott Reynolds, Houston, TX (US); Darrel Pelley, Houston, TX (US)

(73) Assignee: Transocean Sedco Forex Ventures Limited, Grand Cayman (KY)

( * ) Notice: Subject to any disclaimer, the term of this patent is extended or adjusted under 35 U.S.C. 154(b) by 0 days.

(21) Appl. No.: 16/857,510

(22) Filed: Apr. 24, 2020

(65) Prior Publication Data

US 2020/0340324 A1 Oct. 29, 2020

Related U.S. Application Data

(63) Continuation of application No. PCT/US2020/029241, filed on Apr. 22, 2020.
(Continued)

(51) Int. Cl.
*E21B 33/06* (2006.01)
*E21B 33/038* (2006.01)
(Continued)

(52) U.S. Cl.
CPC ..... *E21B 33/063* (2013.01); *E21B 33/038* (2013.01); *E21B 33/0355* (2013.01); *E21B 33/064* (2013.01); *E21B 47/001* (2020.05)

(58) Field of Classification Search
CPC .. E21B 33/063; E21B 33/038; E21B 33/0355; E21B 33/064; E21B 47/001
See application file for complete search history.

(56) References Cited

U.S. PATENT DOCUMENTS 5,978,739 A 11/1999 Stockton
7,367,396 B2 * 5/2008 Springett ..... E21B 33/063 166/298
(Continued)

FOREIGN PATENT DOCUMENTS

DK 2019158174 A1 * 8/2019 ..... E21B 17/085
EP 2458141 A2 5/2012
(Continued)

OTHER PUBLICATIONS

International Search Report and Written Opinion in International Application No. PCT/US2020/029241, dated Jul. 22, 2020, 15 pages.

*Primary Examiner* — James G Sayre
(74) *Attorney, Agent, or Firm* — Cooley LLP

(57) ABSTRACT

In some embodiments, a method for executing an emergency disconnect sequence in shallow water depth includes unlatching a lower marine riser package (LMRP) of a blowout preventer (BOP) from a lower stack of the BOP. The BOP defines a wellbore fluidically coupled to the subsea wellhead. A tubular is disposed within the wellbore. The method further includes shearing the tubular and sealing the wellbore. In response to an indication that a vessel operably coupled to the BOP has failed to keep station, an unlatch sequence and a shear and seal sequence are initiated, such that each sequence occurs at least partially simultaneously. The unlatch sequence includes disconnecting the LMRP from the lower stack, and the shear and seal sequence includes activating the lower stack to shear the tubular in less than about one second and seal the wellbore.

16 Claims, 9 Drawing Sheets

Related U.S. Application Data

(60) Provisional application No. 62/839,205, filed on Apr. 26, 2019.

(51) Int. Cl.
*E21B 47/001* (2012.01)
*E21B 33/035* (2006.01)
*E21B 33/064* (2006.01)

(56) References Cited

U.S. PATENT DOCUMENTS 9,783,199 B2 10/2017 Martin et al.
10,465,466 B2 11/2019 Angstmann et al.
2009/0194290 A1* 8/2009 Parks ..... E21B 33/0355 166/339
2012/0048566 A1 3/2012 Coppedge et al.
2012/0132430 A1 5/2012 Ebenezer
2012/0132431 A1* 5/2012 Ebenezer ..... E21B 33/076 166/340
2013/0220161 A1* 8/2013 Coppedge ..... E21B 34/04 102/531
2015/0104328 A1* 4/2015 Babbitt ..... B01D 61/10 417/2
2015/0176237 A1 6/2015 Li et al.
2015/0233202 A1 8/2015 Caldwell et al.
2016/0090810 A1* 3/2016 Holmes ..... E21B 34/16 166/363
2016/0312563 A1* 10/2016 Rytlewski ..... E21B 33/0355
2018/0202252 A1 7/2018 Pedersen et al.
2019/0203555 A1 7/2019 Gallagher et al.
2019/0338614 A1* 11/2019 Angstmann ..... E21B 33/038
2020/0072012 A1 3/2020 Angstmann et al.

FOREIGN PATENT DOCUMENTS

WO WO 2011/147882 A1 12/2011
WO WO 2018/106347 A1 6/2018

* cited by examiner

STATION KEEPING AND EMERGENCY DISCONNECTING CAPABILITY FOR A VESSEL CONNECTED TO A SUBSEA WELLHEAD IN SHALLOW WATER

CROSS-REFERENCE TO RELATED APPLICATIONS

This application is a continuation of International Application No. PCT/US2020/029241, filed Apr. 22, 2020, entitled "Improved Station Keeping And Emergency Disconnecting Capability For A Vessel Connected To A Subsea Wellhead In Shallow Water", which claims priority to U.S. Provisional Application No. 62/839,205 entitled "Station Keeping And Emergency Disconnecting Capability For A Vessel Connected To A Subsea Wellhead In Shallow Water", filed Apr. 26, 2019, the entire disclosure of each of which is incorporated herein by reference.

BACKGROUND

The present disclosure relates generally to the field of offshore drilling, and in particular, to systems and methods for improved station keeping and rapid disconnecting of an offshore drilling vessel from a wellhead in shallow water drilling operations.

Offshore drilling operations such as shallow or deep water drilling operations can be performed by a vessel such as a floating offshore drilling vessel that is connected by a conduit such as a drilling riser ("riser") to a formation such as a subsea well or wellbore. Various components may be coupled to and/or disposed between the riser and the subsea well, including, for example, a safety device such as a blowout preventer ("BOP"), a flexible joint, a wellhead, and the like.

In some instances, the riser may extend from the vessel and connect to the wellbore via various intervening safety, drilling, and/or related components. Such safety components, may be configured to close, isolate, and/or seal the wellbore to which it is attached, for example, to prevent undesirable fluid flow from the well. Moreover, such safety components can be configured to unlatch or otherwise disconnect the vessel from the wellhead, such as in the case of a station keeping failure event by or of the vessel (e.g., an event in which the vessel has moved too far from the wellhead, thereby failing to keep station).

The safety device may include, for example, a blowout preventer (BOP). BOPs for oil or gas wells are used to prevent potentially catastrophic events known as a blowouts, where high pressures and/or uncontrolled flow from a subsurface formation can blow tubing (e.g. drill pipe and well casing), tools and fluid out of a wellbore. Blowouts present a serious safety hazard to personnel working near the well, the drilling rig and the environment and can be extremely costly.

Despite the various safety devices (e.g., BOP) and precautions (e.g., monitoring station keeping) taken in offshore drilling operations, various risks still exist in offshore drilling operations such as shallow drilling operations due to various environmental conditions, constraints inherent to shallow water environments, and the typical design of vessels used in carrying out the operations. As an example, in attempting to acquire resources via shallow drilling operations that are carried out in increasingly shallow waters, where operating variables and conditions can be seemingly stochastic (e.g., causing fast or sudden shifts or changes in water currents, etc.), and where tolerances between a position of the vessel and the wellhead are increasingly constrained and critical, necessity demands that the operating parameters of systems and components, that is, of the vessels and systems carrying out the operations, enable and allow, among other things, for increasingly robust station keeping and increasingly rapid emergency disconnection (e.g. in case of a station keeping failure), at least to reduce an exposure of the vessels, associated systems, crew, and surrounding environment to risk of loss or damage.

Conventional systems designed to seal a wellbore and disconnect the vessel from the wellhead are unsuitable for shallow water environments due in part to the time these systems require to execute such operations.

Accordingly, there is a need in the art for improved systems and methods for improved station keeping and rapid emergency disconnection, by which to reduce an exposure to risk of loss or damage inherent to performing offshore drilling operations in shallow water environments.

DETAILED DESCRIPTION

Figure 1A:
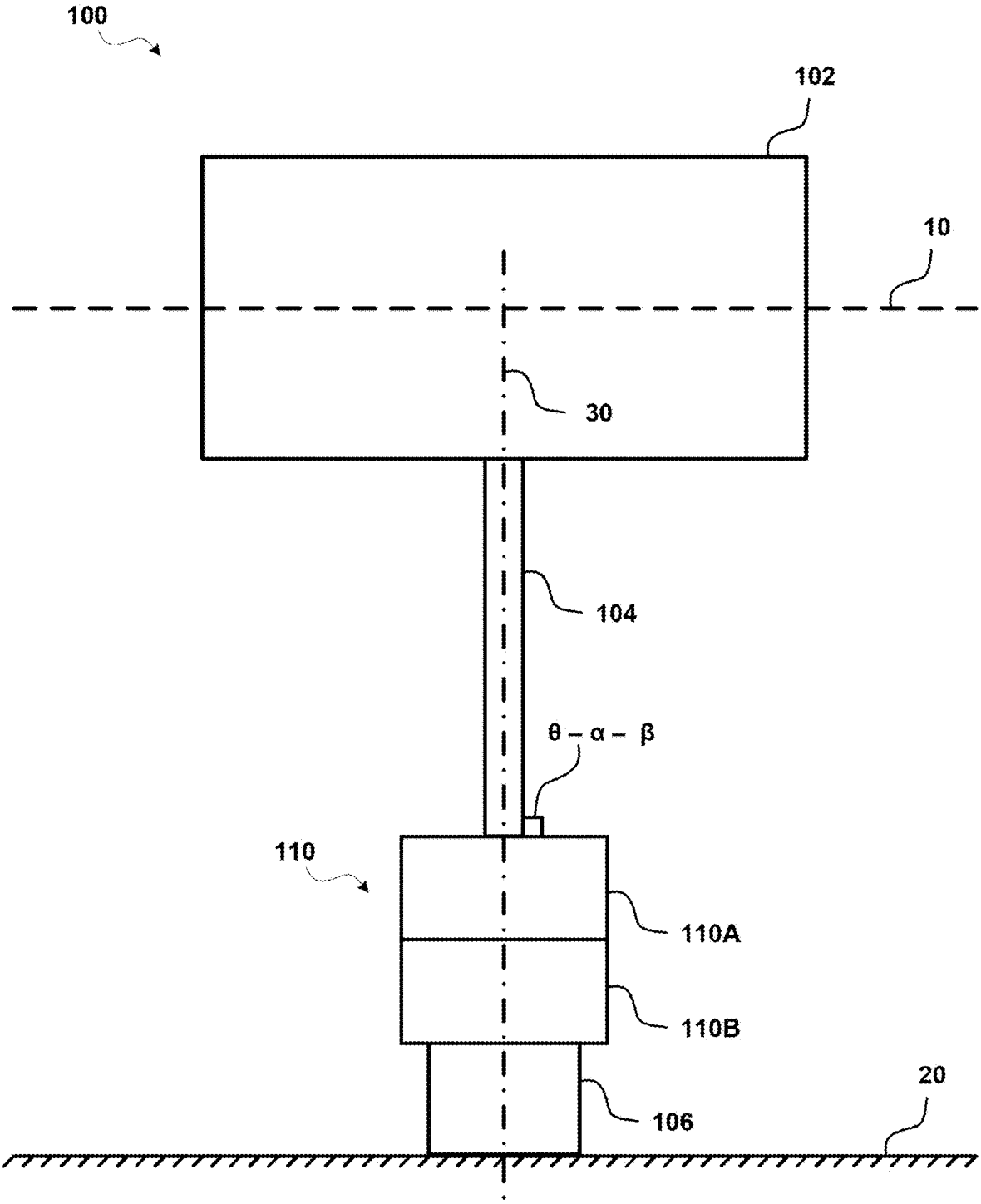
FIGS. 1A-E are schematic diagrams depicting an example offshore drilling platform, in accordance with an embodiment.

FIGS. 1A-E are schematic diagrams depicting an example offshore drilling platform 100, in accordance with an embodiment. As shown in FIG. 1A, the offshore drilling platform 100 includes vessel 102, riser 104, blowout preventer (BOP) 110, and wellhead 106. The offshore drilling platform 100 can be disposed in an environment 101, such as one defined, at least in part, by a body of fluid (e.g. body of water) having an upper surface 10 ("upper surface" or "water surface" or "sea surface" or "ocean surface" or "ceiling") and a lower surface 20 ("lower surface" or "floor" or "seabed"). While the offshore drilling platform 100 is shown as including at least four discrete components, other embodiments can include any number of components.

The offshore drilling platform 100 can be or include, for example, an oil platform, offshore platform, offshore drilling vessel, offshore drilling rig, tension-leg platform, or the like. In use, the offshore drilling platform 100 is free-floating (i.e., untethered to the seabed 20, other than conduit and safety components disposed between the vessel 102 and the wellhead 106). For example, in some instances, the offshore drilling platform 100 can include a free-floating, semi-submersible offshore drilling vessel. The offshore drilling platform 100 can otherwise be or include any other type of natural resource drilling platform, offshore platform, drilling rig, marine vessel, or the like, such as one having facilities to perform a drilling operation, or otherwise, for well drilling to explore, extract, store, and process natural resources, such as petroleum or natural gas from a subsea geographic formation, or any other type of formation, in accordance with embodiments of the present disclosure.

The vessel 102 represents an offshore drilling vessel ("vessel"). For example, the vessel 102 can be or include any type of marine vessel, drilling vessel, semi-submersible vessel, or the like. In some instances, the vessel 102 can be or include a mobile, offshore drilling vessel having a buoyant hull (e.g. having columns, pontoons, buoyancy tanks), capable of controlled movement from place to place, ballasting up or down (e.g. by altering the amount of flooding in buoyancy tanks, etc.), and so on. In some implementations, the vessel 102 is configured to operate in a shallow water depth of anywhere between about 450 feet to about 1,000 feet. In some implementations, the vessel 102 is configured to operation in a shallow water depth of less than about 450 feet.

The riser 104 represents a conduit such as a drilling riser or marine riser pipe configured to provide for access (e.g., for drilling tools and operations) and fluid communication between, for example, the vessel 102 and the BOP 110. The riser 104 extends between the vessel 102 (e.g. positioned at water surface 10) and the BOP 110 during a drilling operation, such as shown in FIG. 1A. The riser 104 can be configured to establish fluid communication with the wellhead 106 via coupling to (and terminating at) a flexible joint (not shown) disposed at or about an upper surface or region of the BOP 110 (e.g. at a top surface of the upper BOP stack 110A). The flexible joint can include any suitable type of flexible joint configured to fluidically couple the riser 104 and the BOP 110, and allow for some relative movement therebetween. In general, the riser 104 can be or include any suitable type of conduit that can be used, for example, for well drilling and/or during a drilling operation to explore, extract, store, and process natural resources, such as petroleum or natural gas, from a subsea geographic formation (e.g. wellhead 106), or any other type of formation, in accordance with embodiments of the present disclosure.

The wellhead 106 represents a structural interface extending from a surface of a geographic formation such as a subsea well or wellbore. In some implementations, the wellhead 106 can be positioned or located at a shallow water depth of less than 450 feet. In some implementations, the wellhead 106 can be positioned or located at a shallow water depth of less than 1,000 feet. The wellhead 106 can otherwise be positioned or located at any non-deepwater depth, in accordance with embodiments of the present disclosure.

The BOP 110 is a safety device, and as shown in FIG. 1A, the BOP 110 includes an upper BOP stack 110A and a lower BOP stack 110B. The BOP 110 can be used, for example, as a safety device to close, isolate, and/or seal a wellbore, such as to prevent or mitigate an inadvertent or unintended release of high-pressure fluid from the wellhead 106 (e.g., during a drilling or production operation). The upper BOP stack 110A and the lower BOP stack 110B can include various devices (e.g., BOPS, rams) designed to isolate the wellbore, such as by shearing a tubular disposed within the wellbore and/or by sealing the wellbore. The upper BOP stack 110A may include a lower marine riser package (LMRP) designed to seal the wellbore, and, in some instances, to shear pipes and/or related equipment that are disposed within the wellbore. Generally, the LMRP is configured to operate as part of a workover system that includes a series of valves coupled to high strength pipe by which a drilling riser (e.g. riser 104) can connect. The LMRP may include, for example, two control systems or pods, with each control pod being associated with a separate hydraulic supply conduit and containing electronics and valves that are used for monitoring and control of a wide variety of functions related to drilling operations.

In use, such as during an offshore drilling operation, the vessel 102 operates unanchored and untethered to any fixed or solid ground (e.g. seabed 20), aside from the conduit, which is not designed to act as a load-bearing or anchoring component and cannot be used to sufficiently anchor the vessel 102. That is, while the vessel 102 is coupled to the wellhead 106 (which is fixed to the seabed 20) via the riser 104 and the BOP 110, the riser 104 and BOP 110 are not designed to maintain (e.g., anchor, tether, etc.) the vessel 102 to maintain it in a safe and operable position relative to the well. Thus, the vessel 102 cannot safely rely on its connection to the wellhead 106 via the riser 104 and/or the BOP 110 to maintain station. As a result, the vessel 102 operates in a free-floating condition and must maintain position, that is, within an acceptable operating zone, distance, area, orientation and/or range of a position of the formation with which it is connected (e.g. via BOP 110), in order to prevent any of the components coupled to and/or disposed between the vessel 102 and the wellhead 106 from inadvertently disconnecting from the well, and/or being subject to undesirable forces that can contribute to equipment failure between the vessel and the well. Maintaining this position is referred to as "station keeping."

For example, once the riser 104 is in place (e.g. coupled to BOP 110) with respect to the wellhead 106, the vessel 102 may maintain station by performing station keeping to prevent the riser 104 from inadvertently disconnecting from the BOP 110. Maintaining the vessel 102 in a sufficiently or substantially stationary, fixed, or otherwise acceptable position with respect to the fixed position of the wellhead 106 is referred to as "station keeping." Given that the vessel 102 is free-floating, to perform station keeping or otherwise maintain station, the offshore drilling platform 100 can include and execute a control system (not depicted), such as, for example, a dynamic positioning (DP) control system ("DP control system" or "dynamic control system"). For example, the vessel 102 may implement a DP control system to control vessel motion such as described in additional detail in U.S. Pat. No. 9,783,199 B2, filed on Mar. 11, 2016 and titled "Dynamic Positioning (DP) Drive-off (DO) Mitigation with inertial navigation system" ("the '199 Patent"), the disclosure of which is incorporated by reference herein in its entirety. Additional technologies designed to improve dynamic positioning and station keeping reliability can include, for example, hybrid power, inertial reference, taut line reference, AGP, AD-CAP, and/or the like.

While maintaining such a fixed position over long periods of times is essential, particularly in shallow water, a failure to maintain station can still occur. In one respect, the nature of being out in open water with few if any reference points can make navigation difficult. For example, given that the vessel 102 is floating in a body of water without being sufficiently anchored to the seabed 20, the vessel's position is particularly vulnerable to and impacted by adverse weather conditions, turbulent water conditions, and the like. Movement of the vessel 102 relative to the wellhead 106, in response to those weather conditions or any other factor that may impact the vessel's 102 position, for example, beyond certain thresholds may in some instances interfere with various drilling operations (e.g., offsetting the vessel from the wellhead such that drilling must stop). For example, movement of the vessel 102 relative to the wellhead 106 beyond certain thresholds may lead to equipment failure, resulting in potential danger to the environment and the crew stationed on the vessel. Operating in shallow waters reduces the thresholds that can lead to such equipment failure. For context, as an example in certain shallow water environments, about a 1% offset may require ceasing of drilling operations, and about a 4% offset may require an emergency disconnection.

In addition to, or aside from, the vessel 102 failing to keep station due to adverse weather conditions, and/or faulty station monitoring, in some instances, the DP control system itself may fail, resulting in driving the vessel 102 off station, also referred to as a drive off event. A drive-off event in which a vessel (e.g., vessel 102) deviates too far from the wellhead to which it is connected, can expose the vessel to risk of inadvertent disconnection, loss, or damage. In other words, a drive-off event is an event in which the DP control system fails to operate properly, causing the vessel to be "driven off," moved outside of, or otherwise deviate too far from its preferred position, or within station. Accordingly, disaster mitigation and detection measures are important, and the quality, accuracy, and speed under which these measures need to operate become increasingly critical and difficult to achieve in shallow water.

A station keeping emergency event can be detected in response to determining that an operating parameter, including, for example, an operating or working angle ("operating angle") between the riser 104 and the upper BOP stack 110A (and/or between a flexible joint and the upper BOP stack 110A, in implementations in which a flexible joint is disposed between the riser 104 and the upper BOP stack 110A), has exceeded a predetermined threshold value, or range of values. Said another way, the operating angle can represent a degree to which the vessel 102 is offset from a longitudinal central axis 30 of the wellbore, i.e., a preferred operation position for the vessel 102. For example, one or more operating angles or angle of operation between the riser 104 and the upper BOP stack 110A (e.g. associated with operating angles corresponding to operating specifications or limits of the flexible joint) can be based on one or more corresponding operating positions of the vessel 102, and further, defined and associated with one or more corresponding operating zones or boundaries (e.g. safe operating zones, hazardous operating zones, dangerous operating zones), so as to define zones within which to maintain station and position of the vessel 102.

That is, safe, hazardous, and dangerous operating angles and/or ranges of angles between the riser 104 and the upper BOP stack 110A can be used to define (e.g. predefine) corresponding safe, hazardous, and dangerous operating zones within which to maintain a station and position of the vessel 102, respectively. Accordingly, the safe, hazardous, and dangerous operating zones may be used to define or delimit the extent or amount of movement or positioning tolerance available to the vessel 102 during an operation.

For example, the safe, hazardous, and dangerous operating zones can be defined as a function of the quantity $\theta-\alpha-\beta$, where "$\theta$" represents an ideal angle of operation (e.g. between riser 104 and BOP 110); "$\alpha$" represents a first degree or extent of deviation (from the ideal angle of operation $\theta$); and "$\beta$" represents a second degree or extent of deviation (from the ideal angle of operation $\theta$). So, if both the first degree of deviation, $\alpha$, and the second degree of deviation, $\beta$, are both equal to zero, then an angular offset (from the ideal angle of operation, $\theta$) value determined, for example, as a function, $f(\theta-\alpha-\beta)$, equals the ideal angle of operation, $\theta$, such as shown in FIG. 1A. Moreover, a station keeping emergency event, for example, in which the vessel 102 has excessively deviated from, or erroneously has a position excursion from a desired set point, such as into the first predefined zone 103 and/or the second predefined zone 105.

In some implementations, an operating angle can be defined as or otherwise include, for example, a critical release angle. In some implementations, the critical release angle can be defined, measured, and/or modeled in real-time (e.g. during a drilling operation), and as discussed in further detail herein can represent an angle beyond which connection of the vessel to the wellhead is too dangerous.

The first degree of deviation and the second degree of deviation can be representative of any suitable situation or warning, and can be defined in any suitable manner, such as to define and characterize predetermined threshold limits, boundaries, or points of disconnect. The first degree of deviation, for example, can be described as a yellow watch circle, or otherwise a condition under which heightened awareness of vessel movement or associated components is warranted. In some instances, the first degree of deviation may represent a condition under which certain operations should be initiated, such as safety-related operations, and/or certain operations should be modified or stopped, e.g., drilling should be stopped temporarily until the vessel returns to an acceptable angle of operation. The second degree of deviation can be described as a red watch circle, or otherwise a condition under which the vessel 102 should be released from the wellhead to avoid undesirable consequences, such as equipment failure, crew and environmental endangerment, and the like. Such release of the vessel 102 is often referred to as and/or is accomplished by an emergency disconnect sequence ("EDS"). Further to this example, beyond the second degree of deviation can represent a point beyond which such failure and/or endangerment is likely to occur. So, in this example, to avoid such undesirable consequences, an EDS needs to be able to be initiated, executed, and completed within the time period during which the vessel 102 enters the range (or red watch circle) defined by the second degree of deviation and exits or otherwise extends beyond the range. Said another way, the red watch circle, in some implementations, can represent a time period allotted for the EDS.

Figure 1B:
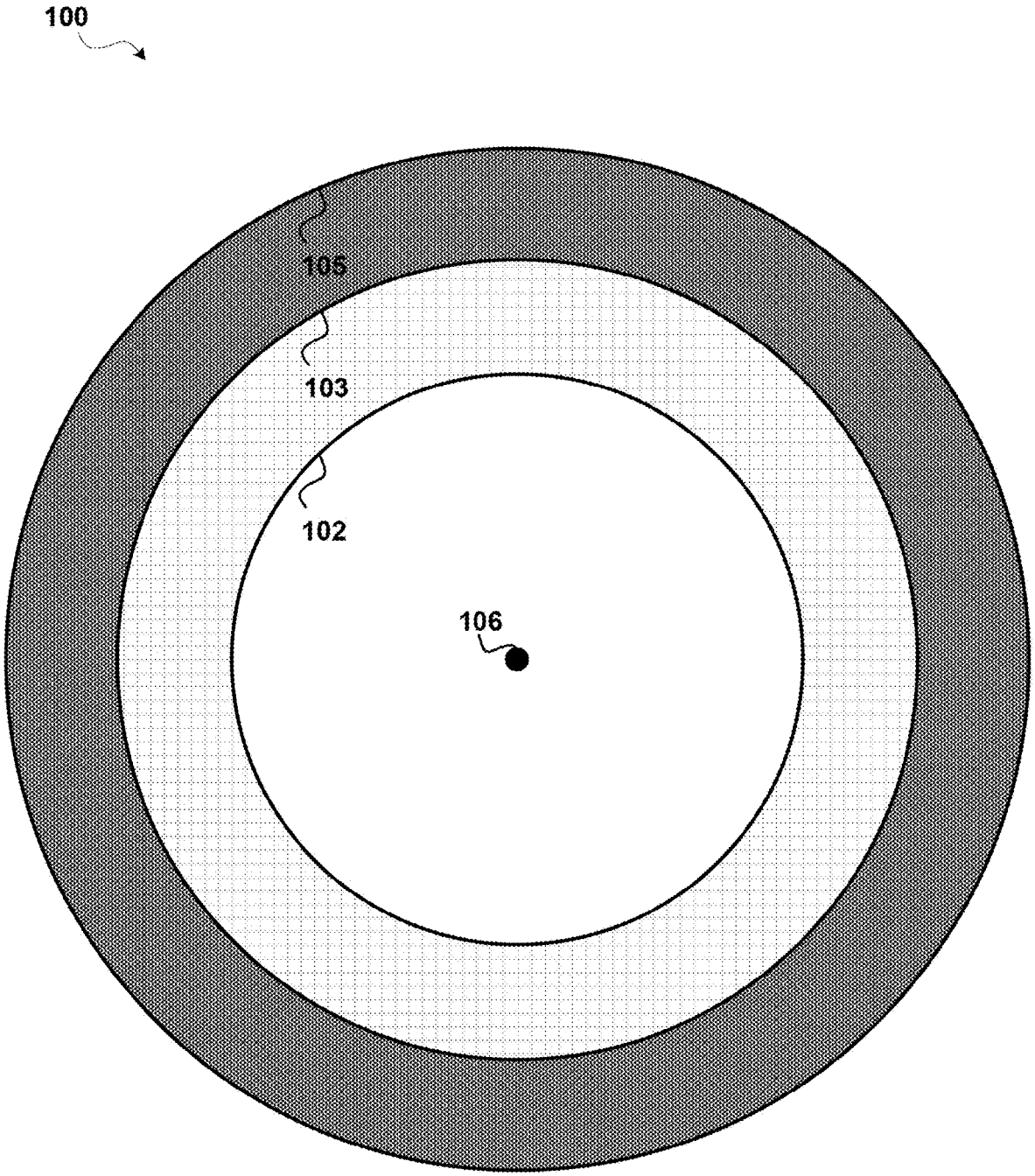

To illustrate the watch circles, FIG. 1B depicts a top view of the offshore drilling platform 100 in a first configuration, corresponding to the configuration of the offshore drilling platform 100 shown in FIG. 1A. That is, the vessel 102 is positioned such that a value of the function $f(\theta-\alpha-\beta)$, corresponding to an angular offset (from the ideal angle of operation, $\theta$), equals the ideal angle of operation, $\theta$ (e.g. 90 degrees). As shown, a first predefined zone 103 and a second predefined zone 105 can be defined in terms of acceptable (e.g., safe) values or operating ranges within which the first degree of deviation, $\alpha$, and the second degree of deviation, $\beta$, respectively, may be ideally maintained. For example, the first predefined zone 103 can be defined with respect to and/or be based on an acceptable operating range, extending to the first degree of deviation, $\alpha$, beyond which continued operation (of vessel 102) may become increasingly risky, and, similarly, the second predefined zone 105 can be defined with respect to and/or be based on an unacceptable operating range, extending to the second degree of deviation, $\beta$, beyond which continued operation and/or connection of the vessel 102 to the wellhead 106 may result in a disaster (e.g., equipment failure, crew or environmental harm, etc.).

In some instances, the first predefined zone 103 and the second predefined zone 105 can be defined, at least in part, based on a water depth of the environment 101, an operating depth of the vessel 102 with respect to a position of the wellhead 106 in the environment 101, a position, velocity, and/or acceleration of the vessel 102, a length of the riser 104, a flexibility of the riser 104, and/or the like. For example, based on an operating depth of the vessel 102, a position of the wellhead 106, and a distance between the vessel 102 and the wellhead 106, the first predefined zone 103 and a second predefined zone 105 can be defined so as to indicate (e.g. to an operator of vessel 102) safe, hazardous, and dangerous operating zones in the environment 101, beyond which increasing exposure of the vessel 102 to risk (e.g. of loss, damage) is likely.

In some instances, the first predefined zone 103 and the second predefined zone 105 can additionally or otherwise be defined, for example, based on real-time values of the operating angles between the riser 104 and the BOP 110 (e.g. via $f(\theta-\alpha-\beta)$). In such instances, the first predefined zone 103 and the second predefined zone 105 can be defined, for example, based on the first degree of deviation, $\alpha$, and the second degree of deviation, $\beta$, respectively, so as to correspond to safe or acceptable, hazardous, and/or dangerous operating zones. Accordingly, as the vessel traverses the environment 101, when the value of the function $f(\theta-\alpha-\beta)$ falls within one of the ranges of the first predefined zone 103 or the second predefined zone 105 (i.e. a value of $f(\theta-\alpha-\beta)$ does not equal the ideal angle of operation, $\theta$), associated predetermined safety measures may be triggered, executed, and performed.

In general, the first degree of deviation, $\alpha$, can be chosen to correspond to a first range of angular offset from the ideal angle of operation, $\theta$, and the second degree of deviation, $\beta$, can be chosen to correspond to a second range of angular offset from the ideal angle of operation, $\theta$. Each of the ideal angle of operation, $\theta$, the first degree of deviation, $\alpha$, and the second degree of deviation, $\beta$, can be chosen as a matter of design, based on, for example, a water depth in which the offshore drilling platform 100 is to operate. Accordingly, corresponding predefined operating zones, within which vessel 102 can safely operate, can be defined based on the difference between values of (i) the ideal angle of operation, $\theta$, and (ii) the first degree of deviation, $\alpha$, and the second degree of deviation, $\beta$. For example, where the vessel 102 fails to maintain station and deviates a distance of approximately 1% from a position of the wellhead (e.g. entering into warning zone), a first remedial action (e.g. operator warning) can be executed, including in some instances a necessity to drop drilling. As another example, where the vessel 102 fails to maintain station and deviates a distance of approximately 4% from a position of the wellhead (e.g. entering into danger zone), a second remedial action (e.g. automatically execute EDS) can be executed.

In some implementations, the first degree of deviation and the second degree of deviation can be representative of any suitable situation or warning, and can be defined in any suitable manner, such as to define and characterize predetermined threshold limits, boundaries, or points of disconnect. The first degree of deviation, for example, can be described as a yellow watch circle, or otherwise a condition under which heightened awareness of vessel movement or associated components is warranted. In some instances, the first degree of deviation may represent a condition under which certain operations should be initiated, such as safety-related operations, and/or certain operations should be modified or stopped, e.g., drilling should be stopped temporarily until the vessel returns to an acceptable angle of operation. The second degree of deviation can be described as a red watch circle, or otherwise a condition under which an emergency disconnection sequence should commence to avoid undesirable consequences, such as equipment failure, crew and environmental endangerment, and the like. Further to this example, beyond the second degree of deviation can represent a point beyond which such failure is likely to occur. So, in this example, to avoid such failure, an EDS needs to be able to be initiated and completed within the time period during which the vessel 102 enters the range (or red watch circle) defined by the second degree of deviation and exits or otherwise extends beyond the range.

The first predefined zone 103 can be associated with or defined as a warning zone, which, when traversed or entered into by the vessel 102, can cause one or more of a first set of predetermined safety measures and/or actions to be executed. Similarly, in some implementations, the second predefined zone 105 can be associated with or defined as a danger zone, which, when traversed or entered into by the vessel 102, can cause one or more of a second set of predetermined safety measures and/or actions to be executed. In some instances, the predetermined safety measures and/or actions include, for example, executing an EDS, as described in further detail herein.

Figure 1C:
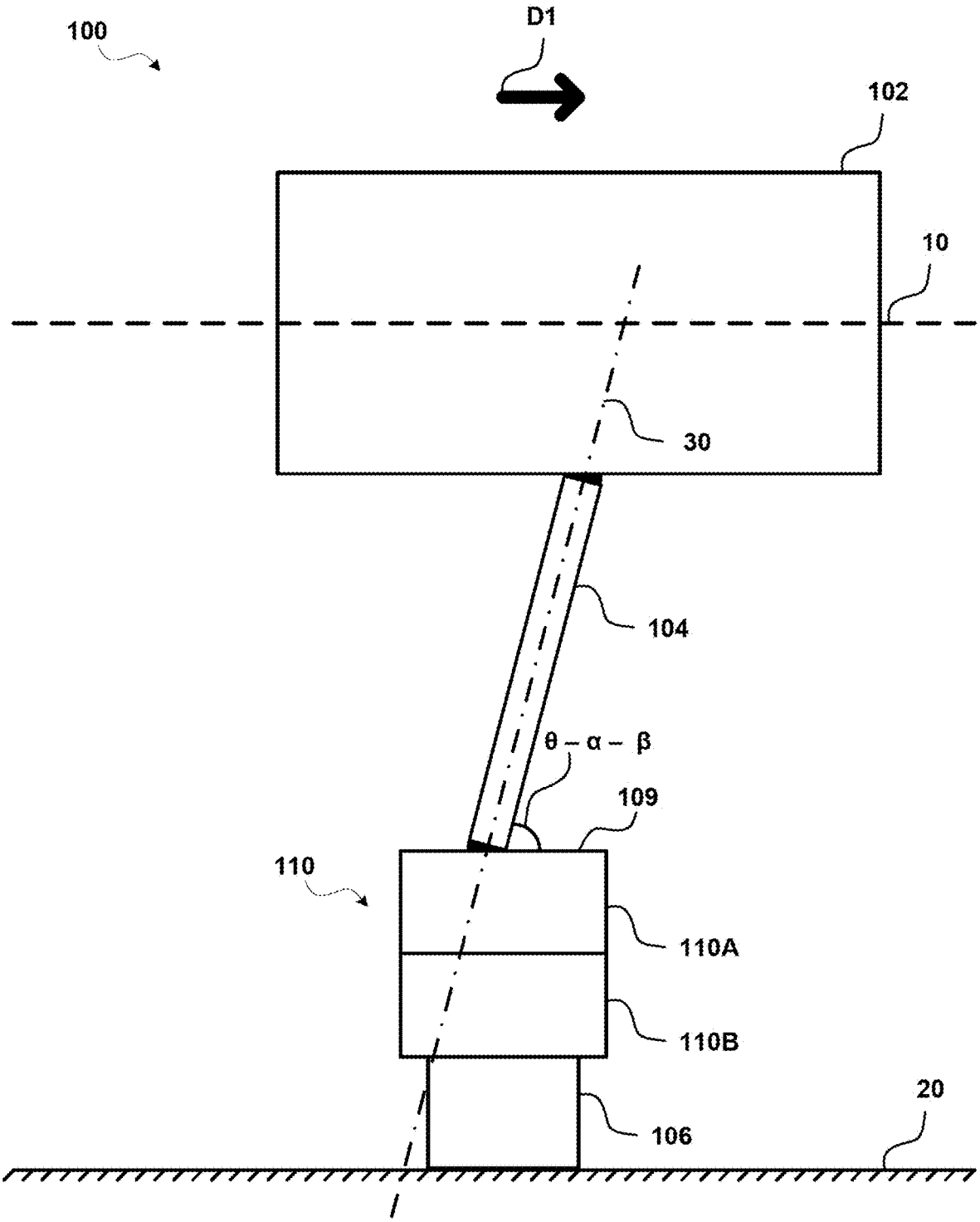
Figure 1D:
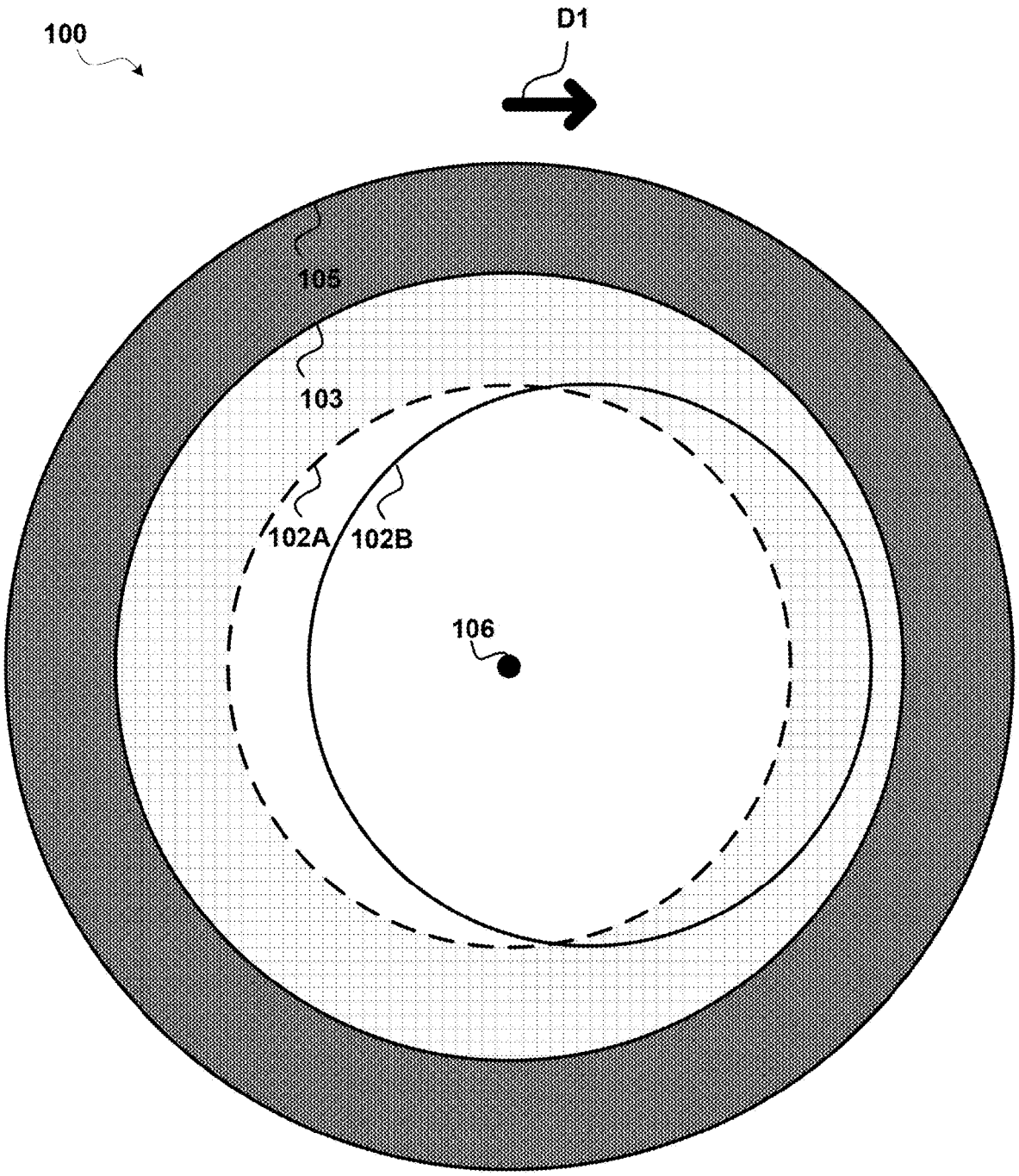

Further to this example, FIGS. 1C and 1D depict a side view and a top view, respectively, of the offshore drilling platform 100 in a second configuration different from the first configuration. Similar to the first configuration, the second configuration can be defined and characterized based on an extent of the angular offset from the ideal angle of operation, $\theta$, as described above, relative to that shown and described with reference to FIGS. 1A and 1B. As shown in FIG. 1C, however, in the second configuration, the vessel 102 has traversed the environment 101 by a distance D1, and its new position with reference to the wellhead 106 and the predefined zones 103, 105 is illustrated in FIG. 1D at 102B (its previous position being similarly illustrated in FIG. 1D at 102A). Accordingly, the vessel 102 is positioned such that the value of the function $f(\theta-\alpha-\beta)$ does not equal the ideal angle of operation, $\theta$ (e.g. offset from 90 degrees), but instead, differs by an amount corresponding to the first degree of deviation, $\alpha$, which, as shown in FIG. 1C, falls within the first predefined zone 103. Accordingly, one or more predetermined safety measures may be triggered, executed, and performed based on the risks associated with operating in and/or beyond the predefined zone 103, as described in further detail herein.

Figure 1E:
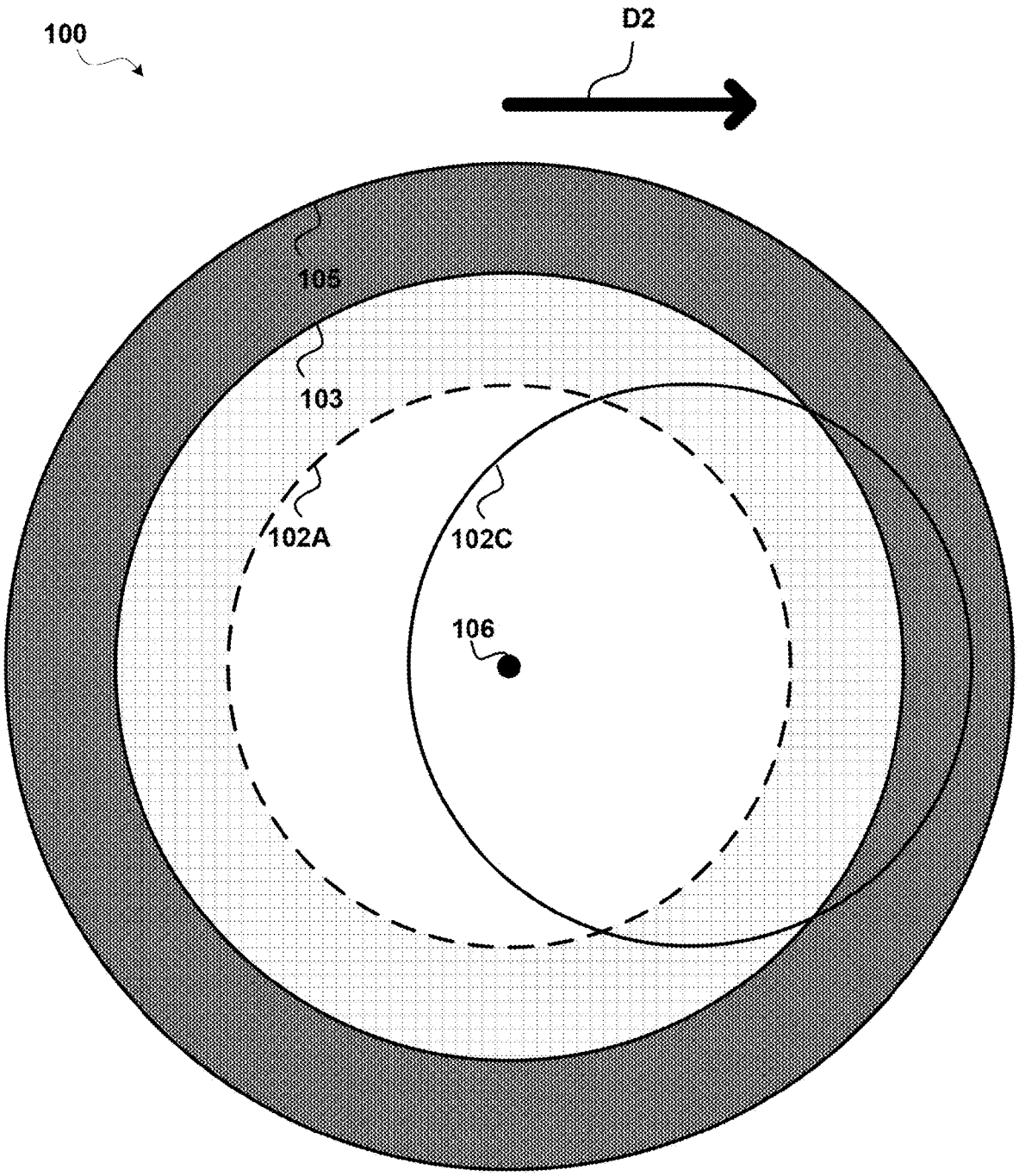

Further to this example, FIG. 1E depicts a top view of the offshore drilling platform 100 in a third configuration different from both the second configuration and the first configuration. Similar to the first configuration and the second configuration, the third configuration can be defined and characterized based on an extent of the angular offset from the ideal angle of operation, $\theta$, as described above, relative to that shown and described with reference to FIGS. 1A-B. As shown in FIG. 1E, the vessel 102 has traversed the environment 101 by a distance D2, which as illustrated is greater than D1. Accordingly, the vessel 102 is positioned such that the value of the function $f(\theta-\alpha-\beta)$ does not equal the ideal angle of operation, $\theta$ (e.g. offset from 90 degrees), but instead, differs by an amount corresponding to the second degree of deviation, $\beta$, which, as shown in FIG. 1E, falls within the second predefined zone 105. Accordingly, one or more predetermined safety measures may be triggered, executed, and performed based on the risks associated with operating in and/or beyond the predefined zone 105, as described in further detail herein.

Referring back to FIG. 1A, the BOP 110 is coupled to the wellhead 106 via its lower BOP stack 110B, and includes a bore (e.g. a throughbore) aligned with the wellbore of the wellhead 106. The BOP 110 can be configured to establish, facilitate, and maintain fluid communication between the riser 104 and the wellhead 106. For example, in some implementations, the riser 104 can be coupled to and terminate substantially at the upper BOP stack 110A via coupling to a flexible joint (not shown), so as to allow some amount of movement of the riser 104 (and the vessel 102) relative to the BOP 110 and the wellhead 106. As discussed in further detail herein, in certain safety-related and/or emergency-related instances, in use (e.g., during a drilling operation), it is desirable to separate the vessel 102 from the well (e.g., from a component coupled to the well, such as the wellhead 106, BOP 110, flexible joint (not shown), and/or the like). Accordingly, the lower BOP stack 110B is removably coupled and/or removably latched to the upper BOP stack 110A such that, when uncoupled or unlatched, the vessel 102, riser 104, and the upper BOP stack 110A can collectively be physically released from the lower BOP stack 110B and the wellhead 106 such that the vessel 102, riser 104, and upper BOP stack 110A can float freely relative to the lower BOP stack 110B and the wellhead 106.

Given the geometrical relationship between the vessel 102 and the wellhead 106, the degree to which the vessel 102 can deviate safely from the wellhead 106 has a direct relationship with, and/or is based at least in part on, the water depth. As water depth decreases, for example, the degree to which vessel 102 motion can deviate safely (e.g., such that the drilling operations can continue, or at least such that the vessel 102 can remain safely attached to the wellhead 106) decreases. So, as water depth decreases, operating tolerances and the amount of time available to react or respond to adverse or hazardous operating conditions and emergency-related events, such as failure to maintain station, also decrease. In fact, operating in increasingly shallow water depths can reduce the amount of time available to respond to adverse or hazardous operating conditions to such an extent that the time it takes a conventional offshore drilling platform to effectively execute an emergency disconnection sequence is greater than the available amount of time to prevent potential catastrophic failure. This makes conventional systems unsuitable to enable the vessel 102 to operate safely (e.g., because they are incapable of releasing the vessel fast enough) in shallow water depths.

Conventional BOPs may include, for example, ram-type pressure control elements disposed in opposed pairs on the BOP housing and may be operated by respective hydraulic ram actuators, e.g., pistons disposed in respective cylinders, all of which are controlled by controllers (e.g., control pods) disposed at the upper BOP stack, LMRP, or at the rig-level/vessel. In this manner, such pressure control elements (along with other lower BOP stack functions) require the lower BOP stack to be latched with the upper BOP stack or LMRP to operate. Furthermore, in instances in which these ram-type pressure control elements are operated by hydraulics supplied with hydraulic fluid from the rig-level, the lower BOP stack must be latched to the upper BOP stack or LMRP, or otherwise coupled to the rig-level/vessel to receive the hydraulic fluid. This necessitates certain steps (e.g., shearing and sealing before unlatching) of an EDS to be performed in series, which adds time to that required to execute and complete an EDS. Hydraulic fluid pressure to operate the various ram-type pressure control elements and/or the annular seal may be controlled by a hydraulic fluid line extending from a control valve manifold to a drilling platform on the water surface, which can add to the time required by conventional BOPs to execute and complete an EDS sequence, since this requires hydraulic connection with components including BOPs such as the BOP 110, to perform the BOP functions before final unlatching (e.g. of the upper BOP stack 110A).

Due to the design of conventional BOPs, the conventional EDS includes closing one or more casing shear ram(s), closing one or more shear blind ram(s), venting or relieving hydraulic pressure, and retracting and unlatching one or more stingers and/or stabs. These functions, which may be referred to generally as shearing, sealing, and unlatching, occur generally sequentially and are performed effectively in series, as they are typically coupled together in a conventional BOP due to its design.

Moreover, in some instances, the conventional BOP may execute an EDS via a control system disposed at rig level and/or at the LMRP. Such a control system, as a result of being disposed at rig level and/or at the LMRP, requires the lower stack of the BOP to remain connected to the upper stack to shear and seal before unlatching can occur since the lower stack of the BOP will need to be accessed by the control system to complete its functions. This increases the time it takes conventional BOPs to execute and complete an EDS.

As a result, the conventional EDS can be relatively long in duration, and, in the case of shallow water drilling operations, too long in duration to effectively execute and complete to prevent or mitigate loss or damage caused by a station keeping emergency event. To be able to operate safely then, the offshore drilling platform needs to be able to predict and react to a station keeping failure by physically uncoupling the vessel from the wellhead and sealing the wellbore—both of which are goals of a successful EDS.

Accordingly, there is a need for a rapid EDS that can be executed and completed (e.g. in the event of station keeping failure) rapidly, such as for use in shallow water drilling operations, and the like. A decoupled sequence whereby certain functions (e.g., lower BOP stack functions, such as shearing and sealing) can be performed rapidly and independently of unlatching the upper BOP stack or LMRP from the lower BOP stack can improve the operating circle within which vessels can safely operate. Further, including alternatives to hydraulic technology (e.g., pyrotechnics) to more quickly separate the vessel from the wellhead and to more quickly shear and seal, can optimize (i.e. sufficiently enlarge) the operating circle within which the vessel can safely operate.

Figure 2:
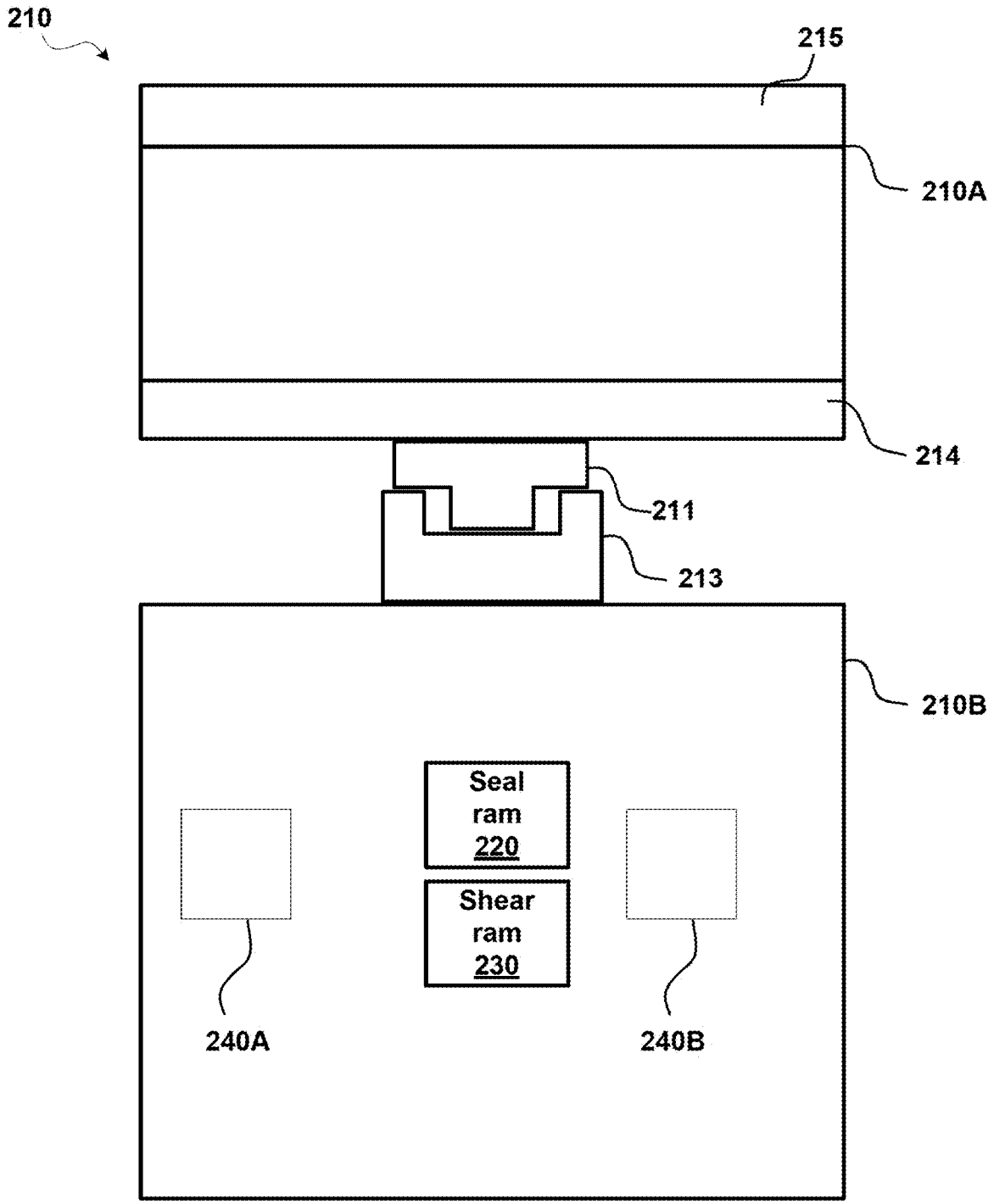
FIG. 2 is schematic diagram depicting a blowout preventer (BOP), in accordance with an embodiment.

FIG. 2 is schematic diagram depicting a blowout preventer (BOP) 210 that is configured to execute a rapid EDS in shallow water depths, in accordance with an embodiment. As shown, the BOP 210 includes upper BOP stack 210A (and LMRP) removably latched to lower BOP stack 210B. The upper BOP stack 210A includes an annular BOP 214, a flexible joint 215, and a mandrel 211. The lower BOP stack 210B includes a seal ram 220, a shear ram 230, a first control system 240A and a second control system 240B (collectively referred to herein as "control systems 240A-B"), and a connector 213. The control systems 240A-B can be the same (e.g., for purposes of redundancy and safety), or the control systems 240A-B can be different (e.g., can include different hardware and be configured to perform different functions). Although this embodiment is described as having two control systems, in other embodiments, a lower BOP stack can have any suitable number of control systems (e.g., one control system or more than two control systems).

The BOP 210 is configured to be coupled to a wellhead (not shown) at the lower BOP stack 210B, and a riser (not shown) at the flexible joint 215. The BOP 210 is configured to execute and complete a rapid EDS, fast enough for use in offshore drilling operations such as shallow water drilling operations, and the like, to provide for reduced risk in shallow water drilling operations (e.g. in the event of a station keeping emergency). In particular, the BOP 210 is configured to execute a rapid EDS as a decoupled sequence of operations, whereby various functions (e.g., shearing and sealing) can be performed independently of unlatching, as described in further detail herein.

The flexible joint 215 is configured to be coupled to a riser (not shown), and the annular BOP 214 is configured to apply hydraulic pressure to force circular steel-reinforced rubber elements to close on and create a seal around a drill pipe or other tools in the wellbore. As shown, the upper BOP stack 210A is removably latched to the lower BOP stack 210B via the mandrel 211 and the connector 213. More specifically, the mandrel 211 extends from a bottom surface of the upper BOP stack 210A, and is configured to be removably coupled or latched with the connector 213 extending from an upper portion or surface of the lower BOP stack 210B. In use, the connector 213 can be energized to release or break its connection with the mandrel 211. For example, in some instances, the connector 213 can be a hydraulic connector that is configured to be hydraulically actuated to unlatch from the mandrel 211. In contrast to many conventional BOPs, which dispose a hydraulic connector at the upper BOP stack or LMRP, here, with the connector 213 disposed in the lower BOP stack 210B, the unlatching step(s) do not require energy communication (e.g., hydraulic fluid flow) to the connector 213 via the upper BOP stack 210A/LMRP.

Although not shown, the annular BOP 214 is coupled to the mandrel 211 via one or more frangible fasteners (e.g., including frangible nuts), such that in certain instances the mandrel 211 and the annular BOP 214 can be quickly separated from each other, as described in further detail herein. In some implementations, for example, in use, at least one explosively frangible fastener coupling the annular BOP 214 to the mandrel 211 can be detonated. In some implementations, the explosively frangible fastener(s) include explosively frangible nut(s), bolt(s), or the like. In some implementations, prior to detonating the at least one explosively frangible fastener, at least one auxiliary line and/or other conduit extending between the upper BOP stack 210A and the lower BOP stack 210B, and/or within the upper BOP stack 210A (e.g., at or near the interface between the annular BOP 214 and the mandrel 211, is uncoupled. Additional detail regarding frangible fasteners can be found in International PCT Patent Application Publication No. WO 2018/106347, filed on Oct. 23, 2017 and titled "Explosive Disconnect," the disclosure of which is incorporated by reference herein in its entirety.

The seal ram 220 can include one or more sealing members or rams, configured to engage to regulate or stop flow through the wellbore when the rams are closed. In some implementations, the seal ram 220 can be or include a shear blind ram (SBR). The shear ram 230 can include one or more shearing members, rams, blades, etc., configured to shear any tubulars or associated components disposed within the wellbore such that the vessel to which the tubular or associated component is attached can be released from the wellhead and such that the wellbore can be sealed. In some implementations, the shear ram 230 can be pyrotechnically actuated to provide rapid shearing. Additional details regarding pyrotechnic shearing can be found in U.S. Pat. No. 7,367,396 B2, filed on Apr. 25, 2006 and titled "Blowout Preventers and Methods of Use," the disclosure of which is incorporated by reference herein in its entirety.

Although not shown, in some implementations, the BOP 210 can include, or is configured to operate in conjunction with, a subsea hydraulic pumping station. For example, in some implementations, a subsea pump can be coupled to the lower BOP stack 210B and configured to hydraulically actuate or otherwise provide hydraulic power to the seal ram 220, and/or other hydraulically-actuated components, such as, for example, the connector 213. In some implementations, one or more hydraulic stabs can be in fluid communication with at least one of the one or more subsea pumps, where the subsea pumping station or apparatus is configured to be in direct fluid communication with a hydraulically actuated device of the BOP 210 via the one or more hydraulic stabs. In some embodiments, the subsea hydraulic pumping station can include pyrotechnic accumulators. Additional detail regarding such subsea pumping stations can be found in U.S. Patent Application No. 2015/0104328 A1, filed on Aug. 15, 2014 and titled "Subsea Pumping Apparatuses and Related Methods," the disclosure of which is incorporated by reference herein in its entirety.

Further to as described above, disposing the control systems 240A-B in the lower BOP stack 210B enables certain functions (e.g., shearing and/or sealing) to be performed at the lower BOP stack even after the lower BOP stack 210B has been unlatched from the upper BOP stack 210A, thereby decoupling these functions (e.g., shearing and/or sealing) from unlatching and/or functions associated therewith. This is an advantage over conventional BOPs, as in conventional BOPs, the lower BOP stack 210B may rely on control signals provided by the upper BOP stack 210A and/or by rig-level components. In some implementations of this embodiment, for example, the rapid EDS can be executed entirely at the lower BOP stack 210B independent of command, control, or automation by automated control systems and/or other components of the offshore drilling platform 100, including, for example, those of the vessel 102 and/or the upper BOP stack 210A. In some instances, the execution of the rapid EDS is first triggered or initiated by a signal provided by the upper BOP stack 210A and/or a component at the rig-level, but then performed at the lower BOP stack 210B independent of further command and/or control by the upper BOP stack 210A and/or a component at the rig-level.

The control systems 240A-B can include, for example, an assembly of valves and regulators (e.g. hydraulically or electrically operated valves and/or regulators) that, when activated in response to a control signal (e.g., transmitted from vessel/rig-level), will direct hydraulic fluid through apertures or the like to operate various BOP functions, accordingly. The control signals can be, for example, electrical signals, optical signals, electromagnetic signals, hydraulic signals, pneumatic signals, acoustic signals, pressure signals, or any other type of signal, which may be chosen as a matter of design based on, for example, a depth at which a wellhead such as the wellhead is located. In some implementations and as described in further detail herein, the control systems 240A-B can be configured to, for example, send a signal to initiate both (1) an unlatch sequence, and (2) a shear and seal sequence. In such implementations, the control systems 240A-B can be configured to send the signal to initiate the unlatch sequence such that energy is transferred to the connector 213 to separate the connector 213 from the mandrel 211 and thereby unlatch the upper BOP stack 210A/LMRP from the lower BOP stack 210B.

Figure 3:
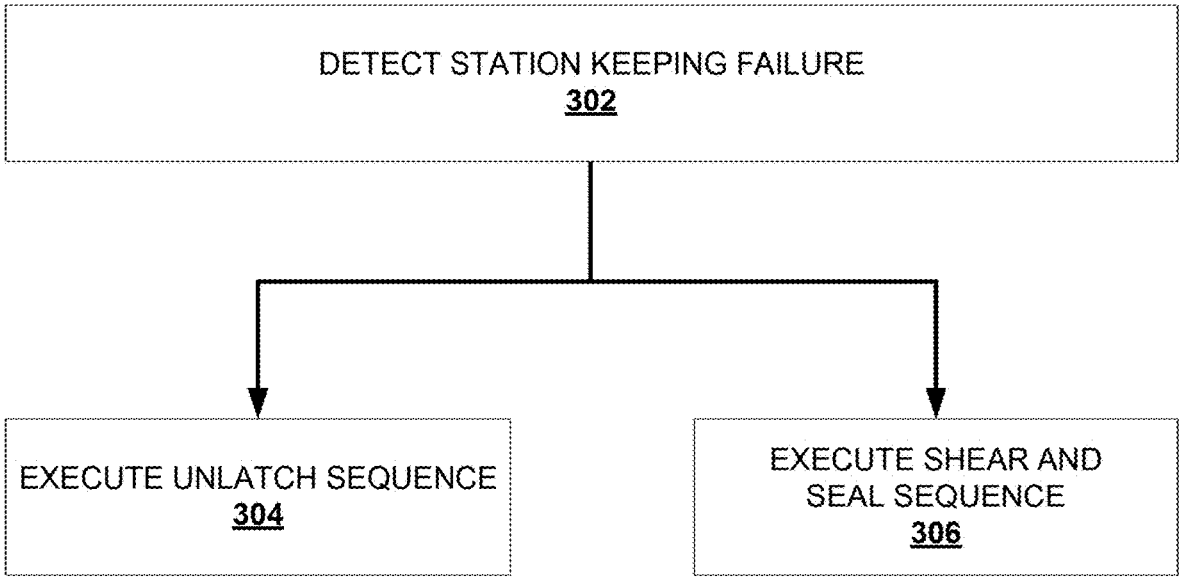
FIG. 3 is a flowchart depicting operational steps of an aspect of the example offshore drilling platform, in accordance with an embodiment.

FIG. 3 is a flowchart depicting operational steps of an aspect of the example offshore drilling platform of FIG. 2, in accordance with an embodiment. The operational steps can be executed or otherwise performed to rapidly and effectively prevent or mitigate a station-keeping failure, such as in a shallow water operating environment (e.g. environment 101), to thereby improve or otherwise provide a more robust fail-safe to support and encourage safe operations in drilling operations carried out in shallow water depths.

For example, the operational steps may be executed in executing an EDS in shallow water depth (e.g., using the BOP 210). The operational steps may include unlatching the upper BOP stack/LMRP (e.g., upper BOP stack 210A) from a lower BOP stack (e.g., BOP 210B). The BOP may define a wellbore fluidically coupled to the subsea wellhead, and have a drill pipe (or other tubular or associated component (s)) disposed within the wellbore. Further, the operational steps may include shearing the drill pipe and sealing the wellbore.

At 302, an indication that a vessel operably coupled to the BOP (e.g., BOP 210) has failed to keep station, is detected. In some implementations, in response to an indication that the vessel operably coupled to the BOP has failed to keep station, both (1) an unlatch sequence, and (2) a shear and seal sequence, such that each sequence occurs at least partially simultaneously, are initiated. In some implementations, the initiation of both the unlatch sequence and the shear and seal sequence is controlled by a control system (e.g. control system 240A) disposed at the lower stack of the BOP and not the LMRP.

At 304, in response to detecting the indication that the vessel operably coupled to the BOP has failed to keep station, an unlatch sequence is executed. In some implementations, the unlatch sequence includes, for example, disconnecting the LMRP (e.g. of upper BOP stack) from the lower BOP stack. In some implementations, the unlatch sequence includes retracting at least one of a stinger or a stab, where the retracting occurs at least partially simultaneously with at least one of the shearing of the drill pipe or the sealing of the wellbore, such as described in further detail herein.

At 306, in response to detecting the indication that the vessel operably coupled to the BOP has failed to keep station, a shear and seal sequence is executed. In some implementations, the shear and seal sequence includes, for example, activating the lower stack to shear the drill pipe using pyrotechnics and seal the wellbore. In some implementations, the shear and seal sequence is executed and contained entirely within the lower stack. In some implementations, activating the lower stack to shear the drill pipe using pyrotechnics and seal the wellbore includes closing a shear blind ram to seal the wellbore. In such implementations, the unlatch sequence includes initiating retraction of at least one of a stinger or a stab before the closing the shear blind ram to seal the wellbore is complete.

In some implementations, activating the lower stack to shear the drill pipe using pyrotechnics and seal the wellbore includes (1) sealing the wellbore within the BOP and external to the drill pipe, and (2) shearing the drill pipe using pyrotechnics. In some implementations, disconnecting the LMRP from the lower BOP stack includes disconnecting an annular BOP from a mandrel of the LMRP using pyrotechnics. In some implementations, using the pyrotechnics includes activating an explosive to disable a frangible fastener disposed between the annular BOP and the mandrel. In some implementations, activating the lower stack to shear the drill pipe using pyrotechnics and seal the wellbore includes activating a hydraulically-actuated shear blind ram to seal the wellbore using hydraulic energy (1) stored subsea and (2) that was pressurized using a pump such as the subsea pump mounted to the lower stack, such as described in further detail herein.

Figure 4:
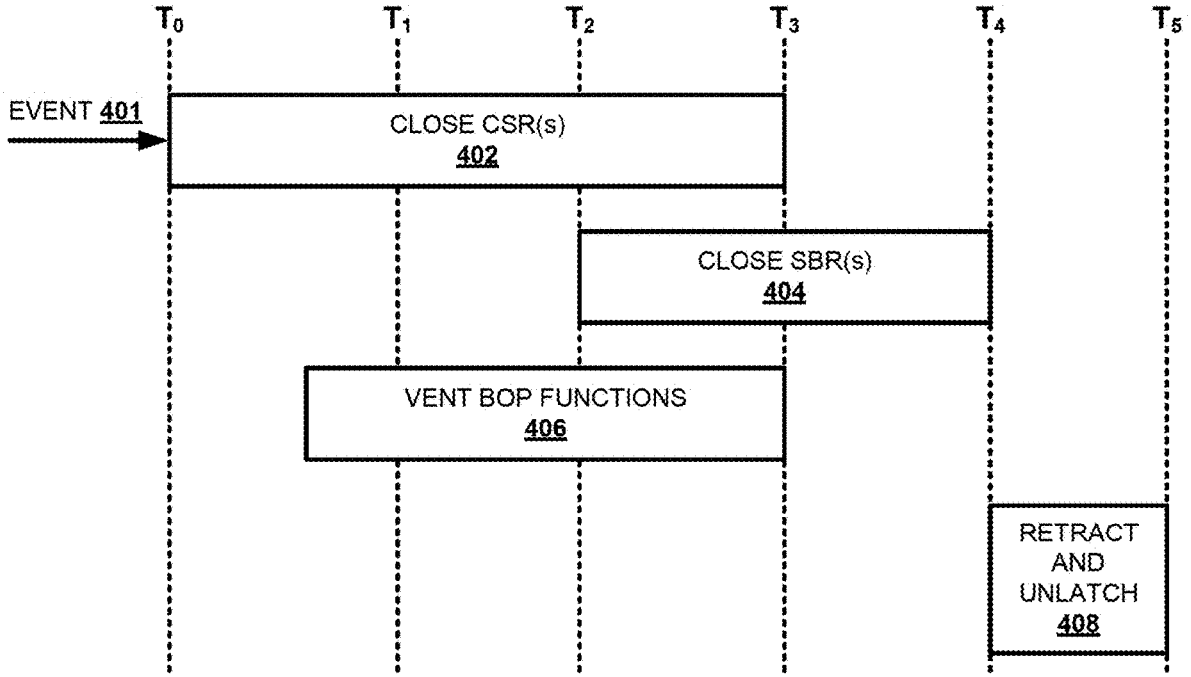
FIG. 4 is a flowchart depicting operational steps of an aspect of an example offshore drilling platform, in accordance with an embodiment.

FIG. 4 is a flowchart depicting an example EDS, in accordance with an embodiment. The example EDS can be, for example, a conventional EDS, executed by a conventional BOP. As shown, at $T=T_0$, an event 401 corresponding to an indication that a vessel (e.g. vessel 102) operably coupled to BOP has failed to keep station is detected, at which time a first sequence 402, at $T_0<T<T_3$, is initiated, by which of one or more casing shear ram(s) are closed. During the first sequence 402, at $T_0<T<T_1$, a second sequence 406 is initiated, by which BOP functions, including venting or relieving hydraulic pressure in the conventional BOP, are initiated. At $T_2<T<T_4$, a third sequence is initiated, by which one or more shear blind ram(s) are closed. At $T_4<T<T_5$, a fourth sequence is initiated, by which one or more stingers and/or stabs are retracted and unlatched. As such, each step is performed substantially in series, with the beginning and end of each sequence (401, 402, 404, 406) being interdependent on one or more other sequences. Moreover, this example EDS is typically performed entirely by the LMRP of a conventional BOP.

Figure 5:
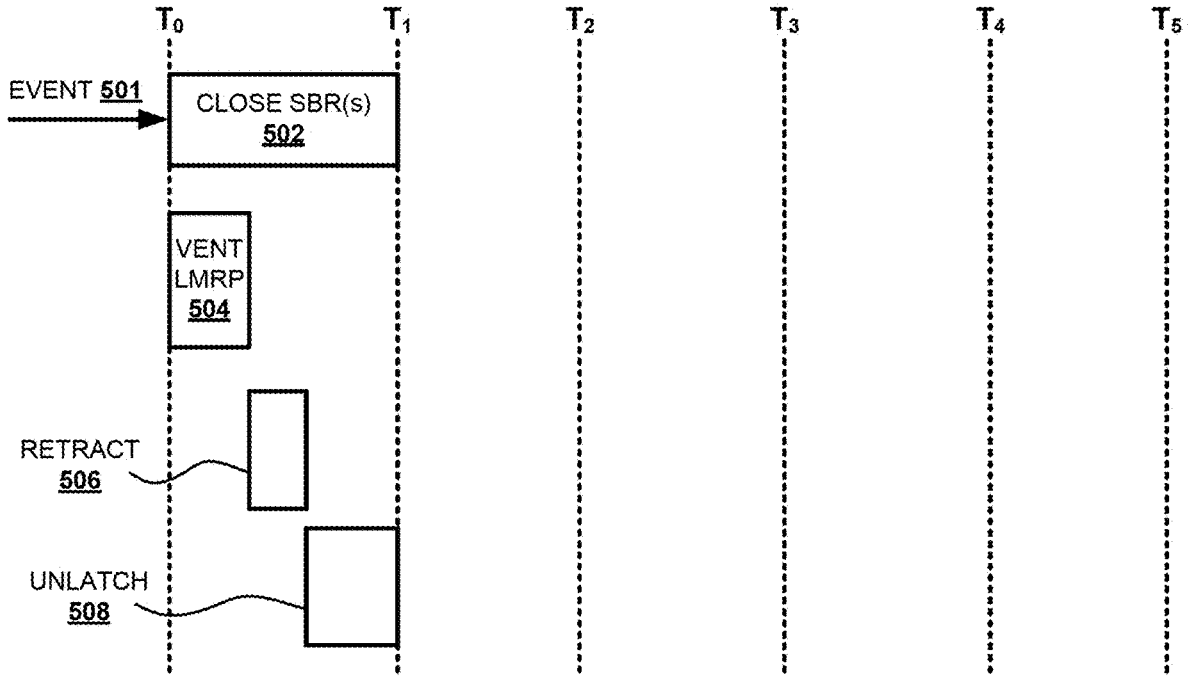
FIG. 5 is a flowchart depicting an example emergency disconnect sequence, in accordance with an embodiment.

FIG. 5 is a flowchart depicting an EDS operable in shallow water depths, in accordance with an embodiment. The EDS can be, for example, executed by a BOP such as the BOP 210. As shown, at $T=T_0$, an event 501 corresponding to an indication that a vessel operably coupled to BOP has failed to keep station is detected, at which time a first sequence 502 and a second sequence 504 are initiated. The first sequence 502 can include, for example, closing one or more SBR(s), such as described herein. The second sequence 504 can include, for example, venting or relieving hydraulic pressure in the BOP. At $T_0<T<T_1$, a third sequence 506 is initiated, by which one or more stingers and/or stabs are retracted. At $T_0<T<T_1$, subsequent to the third sequence 506, a fourth sequence 508 is initiated, by which one or more stingers and/or stabs are unlatched. As such, in this EDS, one or more steps are performed concurrently, and interdependence among the sequences is reduced to thereby reduce a required disconnection time of the EDS.

Figure 6:
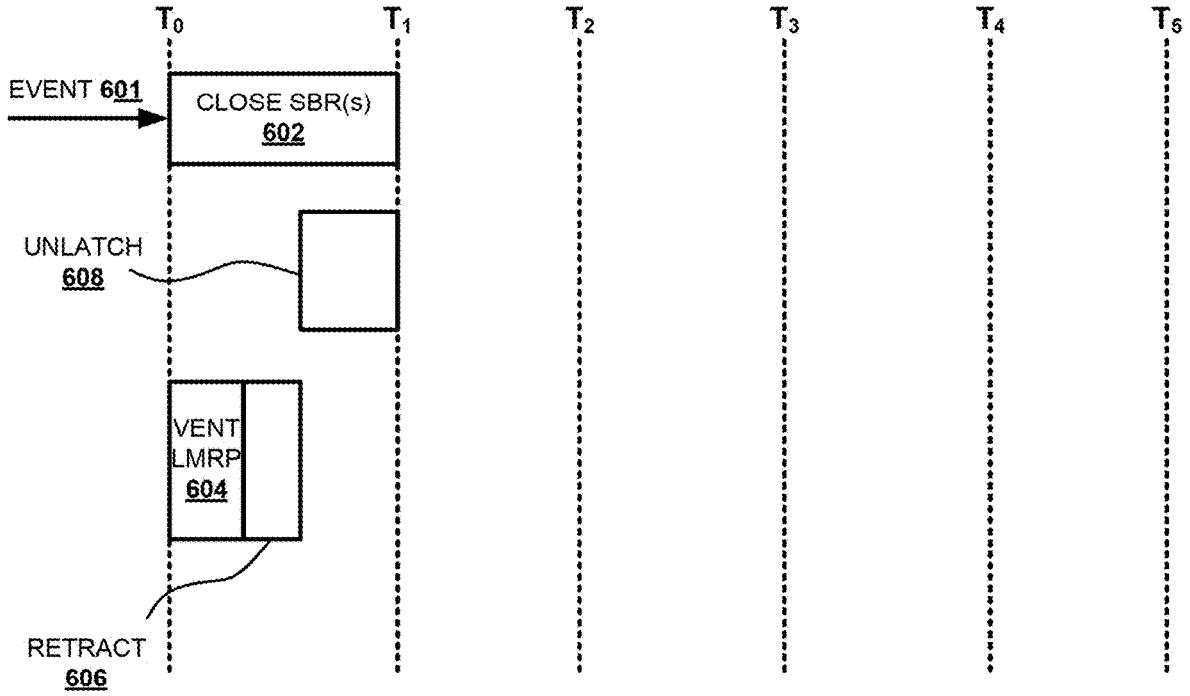
FIG. 6 is a flowchart depicting an emergency disconnect sequence, in accordance with an embodiment.

FIG. 6 is a flowchart depicting an EDS operable in shallow water depths, in accordance with an embodiment. The EDS can be, for example, executed by a BOP such as the BOP 210. As shown, at $T=T_0$, an event 601 corresponding to an indication that a vessel operably coupled to BOP has failed to keep station is detected, at which time a first sequence 602 and a second sequence 604 are initiated. The first sequence 602 can include, for example, closing one or more SBR(s), such as described herein. The second sequence 604 can include, for example, venting or relieving hydraulic pressure in the BOP. At $T_0<T<T_1$, a third sequence 606 is initiated, by which one or more stingers and/or stabs are retracted. At $T_0<T<T_1$, subsequent to the third sequence 606, a fourth sequence 608 is initiated, by which one or more stingers and/or stabs are unlatched. As such, in this EDS, one or more steps are performed concurrently, and interdependence among the sequences is reduced to thereby reduce a duration of the EDS. In some implementations, the first sequence 602 and the fourth sequence 608 can be performed, for example, via the BOP. In some implementations, the second sequence 604 and the third sequence 606 can be performed, for example, via the upper BOP stack.

As described herein, various circumstances can cause a vessel to lose station, particularly in shallow water depths, such that an EDS needs to be executed. In some implementations, it may be desirable to define and execute an EDS that is customized for a given situation. For example, in less severe or time-sensitive circumstances, a less severe EDS can be executed, whereas in a more severe, very time-sensitive circumstances, a more severe EDS can be executed—the more severe EDS requiring additional time and expense to restart drilling operations and relatch and/or operably connect the vessel to the wellhead.

To this end, for example, in some embodiments, an EDS can include a first mode involving shearing a tubular (e.g., drill pipe, tools, joints, bits, and the like) within the wellbore, sealing the wellbore, and unlatching the BOP, and can be executed using an improved BOP (e.g., BOP 210). The first mode can include, in response to an indication that a vessel operably coupled to the BOP has failed to keep station, actuating (e.g., via pyrotechnics) the shear ram 230, and actuating the seal ram 220 (e.g., a shear blind ram), and unlatching the connector 213 of the lower BOP stack 210B from the mandrel 211 of the upper BOP stack. In some implementations, the first mode can be executed and performed (e.g., from start to end) in less than or equal to about 15 seconds.

Additionally, to address circumstances in which a tubular disposed within the wellbore is shearable by a shear blind ram (e.g., shear blind ram 220), a second mode can be employed to shear the tubular using the shear blind ram 220 rather than and without actuating a pyrotechnically-actuated shear ram (e.g., shear ram 230). In this manner, relatching and reestablishing drilling operations can commence without having to reload any of the pyrotechnics, thereby reducing the negative impact or undesirably delays caused by executing the EDS. In some implementations, the second mode can be executed and performed (e.g., from start to end) in less than or equal to about 15 seconds.

Further, in situations in which the vessel needs to be separated from the wellhead as quickly as possible (e.g., the primary goal is separation, with less emphasis on subsequent efforts to reestablish connection and drilling operations), a third mode can be employed. The third mode can include, rather than unlatching the mandrel 211 from the connector 213, separating the annular BOP 214 from the mandrel 211 by way of exploding the frangible fastener(s) disposed therebetween. Separating in this manner, for example, can be much faster than the unlatching performed in the first and second modes. Further, before and/or at the same time of separation in response to the frangible fastener(s) exploding, the shear ram 230, e.g., using pyrotechnics, can shear any tubulars or associated components disposed within the wellbore, and at or immediately after the time of separation in response to the frangible fastener(s) exploding, the seal ram 220 can seal the wellbore. In some instances, due to the separation of the annular BOP 214 from the mandrel 211 before the wellbore is sealed by the seal ram 220, a small amount of leaking or environmental discharge may occur, however it should be appreciated that the third mode is configured to prevent a much greater disaster than a small amount of discharge. Sealing after disconnection, in this manner, is enabled at least in part to the control systems and/or hydraulics being located at the lower BOP stack 210B, as described in further detail herein. In some implementations, the third mode can be executed and performed (e.g., from start to end) in less than or equal to about 1 second. In some instances, the pyrotechnic shearing of the tubular and/or the separation of the annular BOP from the mandrel 211 can occur in less than or equal to about 10 milliseconds (e.g., substantially instantaneously).

In some implementations, an EDS can be selectively executed, such as by an operator or user, in the first, second, and/or third mode, during a drilling operation. In some implementations, the EDS, can be selectively and automatically executed, such as based on an operating condition or parameter during a drilling operation. The operating condition or parameter can include any suitable operating condition or parameter, such as any one or more of those described herein. The operating condition or parameter can otherwise include any suitable operating condition or parameter, such as one chosen as a matter of design, based, for example, on an operating environment. The mode, for example, can be selected in real-time based on station-keeping sensors and parameters and/or feedback from the dynamic positioning system. For example, in response to a drive-off event being detected, the third mode can be selected and/or executed in order to separate the vessel from the wellhead as quickly as possible. Further, the various modes, and the specific sequences and functions performed in connection with the same, can be defined or redefined in real-time by, for example, an operator of the rig. In some implementations, the EDS system and associated modes can be defined and/or selected for execution by the dynamic positioning system.

While various embodiments described herein in connection with releasing the vessel from the wellhead include using a BOP, and its components, mechanisms, and/or systems, releasing or unlatching the vessel from the wellhead can be accomplished additionally or alternatively using any subsea equipment latched to the wellhead (e.g., shut-in device, subsea tree, and the like). For example, such subsea equipment can include a subsea shut-in device attached (e.g., attached directly) to the wellhead and between the wellhead and the lower BOP stack, with one or more frangible fasteners disposed between the shut-in device and the lower BOP stack. In this manner, to disconnect and release the vessel from the wellhead, the one or more frangible fasteners can be charges or otherwise exploded to separate the BOP from the shut-in device (and wellhead to which the shut-in device is coupled).

While various embodiments described herein in connection with releasing the vessel from the wellhead include subsea energy release, such as pyrotechnics, quick enough to allow the vessel to be released from the wellhead safely, in time periods faster than traditional systems would allow, in some embodiments, other types of subsea energy can be used, e.g., to initiate and/or execute a shear and seal sequence, including, for example hydraulics, electrical, and chemical (e.g., battery). In some implementations, shearing and sealing can use the same energy type, while in some implementations, shearing and sealing can use different forms of energy, such as, for example, hydraulics for shearing and electrical for sealing.

Various embodiments described herein focus on releasing the vessel from the wellhead (e.g., by executing an EDS) in a fast enough manner to safely disconnect the vessel from the wellhead. In some implementations, in accordance with various embodiments described herein, the vessel can be released from the wellhead in less than about 1 minute, in less than about 30 seconds, in less than about 15 seconds, in less than about 10 seconds, in less than about 2 seconds, and in about 1 to about 2 seconds, and any subranges therebetween. Enabling such disconnect times allows for such vessels to operate effectively and safety within shallow waters.

Various embodiments described herein refer to parameters under which an EDS would be initiated, such as, for example, a critical release angle or a threshold angle that when reached could trigger an EDS. Additionally, or alternatively, in some implementations, EDS triggering parameters can include, for example, GPS data, bending moment data associated with the riser, tensioner stroke, and/or data associated with the telescopic joint.

In any of the embodiments described herein, one or more of the components or systems described therein can be tested in the field to ensure that they will work properly in the event of a station keeping emergency/event. For example, pumps associated with the subsea pumping station can be activated and tested when installed subsea. Similarly, the frangible fastener(s) can be tested when installed subsea. In some instances, these tests can be scheduled and executed automatically, whereas in other instances they can be additionally or alternatively triggered manually by an operator. Further, a tracking and/or reporting system can be employed to indicate (e.g., to an operator) status of various devices (e.g., to meet industry-required seal requirements, tests and reports may be required). In this manner, an operator can quickly and easily determine the readiness of the safety system before a station keeping event occurs necessitating an EDS.

While various embodiments have been described above, it should be understood that they have been presented by way of example only, and not limitation. Where methods described above indicate certain events occurring in certain order, the ordering of certain events may be modified. Where methods and/or schematics described above indicate certain events and/or flow patterns occurring in a certain order, the ordering of certain events and/or flow patterns can be modified. For example, certain of the events may be performed simultaneously with one or more other events, out of order, and/or not at all. Additionally, certain of the events may be performed concurrently in a parallel process when possible, as well as performed sequentially as described above.

Where schematics and/or embodiments described above indicate certain components arranged in certain orientations or positions, the arrangement of components may be modified. While the embodiments have been particularly shown and described, it will be understood that various changes in form and details may be made. Any portion of the apparatus and/or methods described herein may be combined in any combination, except mutually exclusive combinations. The embodiments described herein can include various combinations and/or sub-combinations of the functions, components and/or features of the different embodiments described.

The flowchart and block diagrams as shown in the Drawings illustrate the architecture, functionality, and operation of possible implementations of systems, methods, and computer readable media according to various embodiments of the present disclosure. In this regard, each block in the flowchart or block diagrams may represent a module, segment, or portion of instructions, which includes one or more executable instructions for implementing the specified logical function(s). In some implementations, the functions noted in the blocks may occur out of the order noted in the Drawings. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Detailed embodiments of the present disclosure are disclosed herein for purposes of describing and illustrating claimed structures and methods that may be embodied in various forms, and are not intended to be exhaustive in any way, or limited to the disclosed embodiments. Many modifications and variations will be apparent to those of ordinary skill in the art without departing from the scope and spirit of the disclosed embodiments. The terminology used herein was chosen to best explain the principles of the one or more embodiments, practical applications, or technical improvements over current technologies, or to enable those of ordinary skill in the art to understand the embodiments disclosed herein. As described, details of well-known features and techniques may be omitted to avoid unnecessarily obscuring the embodiments of the present disclosure.

References in the specification to "one embodiment," "an embodiment," "an example embodiment," or the like, indicate that the embodiment described may include one or more particular features, structures, or characteristics, but it shall be understood that such particular features, structures, or characteristics may or may not be common to each and every disclosed embodiment of the present disclosure herein. Moreover, such phrases do not necessarily refer to any one particular embodiment per se. As such, when one or more particular features, structures, or characteristics is described in connection with an embodiment, it is submitted that it is within the knowledge of those skilled in the art to affect such one or more features, structures, or characteristics in connection with other embodiments, where applicable, whether or not explicitly described.

While some implementations have been described and illustrated herein, those having ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto; and that embodiments may be practiced otherwise than as specifically described and claimed without departing from the scope and spirit of the present disclosure. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope and spirit of the present disclosure.

What is claimed is:

1. A method for executing an emergency disconnect sequence in shallow water depth including (1) unlatching a lower marine riser package (LMRP) of a blowout preventer (BOP) from a lower stack of the BOP, the BOP (a) defining a wellbore fluidically coupled to the subsea wellhead, and (b) having a tubular disposed within the wellbore, and (2) shearing the tubular and sealing the wellbore, the method comprising:

in response to an indication that a vessel operably coupled to a BOP has failed to keep station, initiating, using a control system disposed at the lower stack of the BOP and not the LMRP, both (1) an unlatch sequence, and (2) a shear and seal sequence, such that each sequence occurs at least partially simultaneously, the unlatch sequence including disconnecting the LMRP from the lower stack, the shear and seal sequence including activating the lower stack to shear the tubular in less than about one second and seal the wellbore.

2. The method of claim 1, wherein the unlatch sequence includes retracting at least one of a stinger or a stab, the retracting occurring at least partially simultaneously with at least one of the shearing of the tubular or the sealing of the wellbore.

3. The method of claim 1, wherein the activating the BOP includes:

(1) sealing the wellbore within the BOP and external to the tubular, and (2) shearing the tubular using chemical energy stored subsea.

4. The method of claim 1, wherein the activating the BOP includes activating a hydraulically-actuated shear blind ram to seal the wellbore using hydraulic energy (1) stored subsea and (2) that was pressurized using a pump mounted to the lower stack.

5. The method of claim 1, wherein the LMRP has a mandrel and the lower stack has a connector removably coupled to the mandrel, the mandrel being a male component and the connector being a female component, the unlatch sequence including energizing the connector to disconnect the connector from the mandrel.

6. The method of claim 1, wherein the shallow water depth is less than 1,000 feet.

7. The method of claim 1, wherein the shallow water depth is less than 450 feet.

8. The method of claim 1, wherein the emergency disconnect sequence is completed in less than about 30 seconds.

9. The method of claim 1, wherein the emergency disconnect sequence is completed in less than about 10 seconds.

10. The method of claim 1, wherein the unlatch sequence includes retracting a stinger, the retracting occurring at least partially simultaneously with the shearing of the tubular.

11. A blow-out preventer (BOP), comprising:

a lower marine riser package (LMRP) having a mandrel, and a lower stack having a connector removably coupled to the mandrel of the LMRP, the lower stack including a control system configured to send a signal to initiate both (1) an unlatch sequence, and (2) a shear and seal sequence, the unlatch sequence including disconnecting the LMRP from the lower stack, the shear and seal sequence including activating a sealing ram to shear a tubular disposed within a wellbore of the BOP and activating a shear blind ram (SBR) to seal the wellbore.

12. The BOP of claim 11, wherein the shear and seal sequence includes using at least one of pyrotechnics, hydraulics, chemical energy, or electrical energy to at least one of shear the tubular or seal the wellbore.

13. The BOP of claim 11, wherein the shear and seal sequence includes activating the sealing ram to shear the tubular using battery-powered hydraulics and activating the SBR to seal the wellbore using battery-powered hydraulics.

14. The BOP of claim 11, wherein the disconnecting includes transferring energy from the connector to the mandrel to unlatch the LMRP from the lower stack.

15. The BOP of claim 11, further comprising:

a subsea pumping station coupled to the lower stack and configured to provide hydraulic power to the SBR to seal the wellbore.

16. The BOP of claim 11, further comprising:

a pyrotechnic accumulator coupled to the lower stack and configured to provide hydraulic power to the SBR to seal the wellbore.

* * * * *